US011913310B2

(12) United States Patent
Masters

(10) Patent No.: US 11,913,310 B2
(45) Date of Patent: Feb. 27, 2024

(54) SOLID STATE DUAL FIRE CIRCUIT

(71) Applicant: Hunting Titan, Inc., Pampa, TX (US)

(72) Inventor: Stephen C. Masters, Pampa, TX (US)

(73) Assignee: Hunting Titan, Inc., Pampa, TX (US)

( * ) Notice: Subject to any disclaimer, the term of this patent is extended or adjusted under 35 U.S.C. 154(b) by 156 days.

(21) Appl. No.: 17/440,704

(22) PCT Filed: Mar. 27, 2020

(86) PCT No.: PCT/US2020/025375

§ 371 (c)(1),
(2) Date: Sep. 17, 2021

(87) PCT Pub. No.: WO2020/198643

PCT Pub. Date: Oct. 1, 2020

(65) Prior Publication Data

US 2022/0170349 A1 Jun. 2, 2022

Related U.S. Application Data

(60) Provisional application No. 62/824,882, filed on Mar. 27, 2019.

(51) Int. Cl.

| | |
|---|---|
| ***F42D 1/055*** | (2006.01) |
| ***E21B 43/1185*** | (2006.01) |
| ***E21B 43/119*** | (2006.01) |

(52) U.S. Cl.

CPC ..... *E21B 43/1185* (2013.01); *E21B 43/119* (2013.01); *F42D 1/055* (2013.01)

(58) Field of Classification Search

None

See application file for complete search history.

(56) References Cited

U.S. PATENT DOCUMENTS

| | | | | |
|---|---|---|---|---|
| 4,208,966 | A | 6/1980 | Hart | |
| 6,179,064 | B1 | 1/2001 | Vaynshteyn | |
| 8,091,477 | B2 * | 1/2012 | Brooks | E21B 43/1185 361/251 |
| 2010/0286800 | A1 | 11/2010 | Lerche et al. | |
| 2011/0271823 | A1 | 11/2011 | Vicente | |
| 2014/0151018 | A1 | 6/2014 | Lerche et al. | |
| 2017/0211482 | A1 | 7/2017 | Kempinski | |

OTHER PUBLICATIONS

Extended European Search Report, dated Nov. 14, 2022, 8 pages.
Notification of transmittal of the International Search Report and the Written Opinion of the International Searching Authority, or the Declaration, dated Jul. 30, 2020, PCT/US20/25375, 11 pages.
Dilog, Jan. 11, 2016 Gamma Gun (Scintillation) 2016. [retrieved on Jul. 15, 2020]. Retrieved from the Internet. URL: http://oilog.us/products/1-1116-gamma-gun-scintillation/ (2 pages).

* cited by examiner

*Primary Examiner* — Reginald S Tillman, Jr.

(57) ABSTRACT

A method and apparatus for firing a detonator in a perforating gun string into a wellbore to a predetermined location using solid state electronics comprising: raising the voltage on the wireline to signal a solid state dual firing circuit within the perforating gun string to energize a detonator, energize the detonator, opening the detonator, firing a first perforating gun, and lowering the voltage of the wireline.

16 Claims, 9 Drawing Sheets

SOLID STATE DUAL FIRE CIRCUIT

RELATED APPLICATIONS

This application claims priority to U.S. Provisional Application No. 62/824,882, filed Mar. 27, 2019.

BACKGROUND OF THE INVENTION

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

A subsurface or subterranean well transits one or more formations. The formation is a body of rock or strata that contains one or more compositions. The formation is treated as a continuous body. Within the formation hydrocarbon deposits may exist. Typically, a wellbore will be drilled from a surface location, placing a hole into a formation of interest. Completion equipment will be put into place, including casing, tubing, and other downhole equipment as needed. Perforating the casing and the formation with a perforating gun is a well-known method in the art for accessing hydrocarbon deposits within a formation from a wellbore.

Explosively perforating the formation using a shaped charge is a widely known method for completing an oil well. A shaped charge is a term of art for a device that when detonated generates a focused output, high energy output, and/or high velocity jet. This is achieved in part by the geometry of the explosive in conjunction with an adjacent liner. Generally, a shaped charge includes a metal case that contains an explosive material with a concave shape, which has a thin metal liner on the inner surface. Many materials are used for the liner; some of the more common metals include brass, copper, tungsten, and lead. When the explosive detonates, the liner metal is compressed into a super pressurized jet that can penetrate metal, concrete, and rock. Perforating charges are typically used in groups. These groups of perforating charges are typically held together in an assembly called a perforating gun. Perforating guns come in many styles, such as strip guns, capsule guns, port plug guns, and expendable hollow carrier guns.

Perforating charges are typically detonated by detonating cord in proximity to a priming hole at the apex of each charge case. Typically, the detonating cord terminates proximate to the ends of the perforating gun. In this arrangement, an initiator at one end of the perforating gun can detonate all of the perforating charges in the gun and continue a ballistic transfer to the opposite end of the gun. In this fashion, numerous perforating guns can be connected end to end with a single initiator detonating all of them.

The detonating cord is typically detonated by an initiator triggered by a firing head. The firing head can be actuated in many ways, including but not limited to electronically, hydraulically, and mechanically.

Expendable hollow carrier perforating guns are typically manufactured from standard sizes of steel pipe with a box end having internal/female threads at each end. Pin ended adapters, or subs, having male/external threads are threaded one or both ends of the gun. These subs can connect perforating guns together, connect perforating guns to other tools such as setting tools and collar locators, and connect firing heads to perforating guns. Subs often house electronic, mechanical, or ballistic components used to activate or otherwise control perforating guns and other components.

Perforating guns typically have a cylindrical gun body and a charge tube, or loading tube that holds the perforating charges. The gun body typically is composed of metal and is cylindrical in shape. Charge tubes can be formed as tubes, strips, or chains. The charge tubes will contain cutouts called charge holes to house the shaped charges.

Electric initiators are commonly used in the oil and gas industry for initiating different energetic devices down hole. Most commonly, 50-ohm resistor initiators are used. Other initiators and electronic switch configurations are common.

SUMMARY OF EXAMPLE EMBODIMENTS

An example embodiment may include a method for firing a detonator including lowering a perforating gun string into a wellbore to a predetermined location, raising the voltage on the wireline to signal a solid state dual firing circuit within the perforating gun string to energize a detonator, energize the detonator, opening the detonator, firing a first perforating gun, and lowering the voltage of the wireline.

A variation of the example embodiment may include reversing the polarity of the wireline voltage and ramping up the reverse polarity voltage to fire a second perforating gun. It may include deactivating electrically powered instruments coupled to the perforating gun string. It may include deactivating a gamma tool integral with the perforating gun string.

An example embodiment may include a solid state dual fire circuit having a transformer with a primary coil, a first secondary coil, a second secondary coil, and a third secondary coil, a first MOSFET (Q1), wherein the first MOSFET controls whether the bottom of the tool is shorted to ground, a second MOSFET (Q5), wherein the second MOSFET engages or disengages a voltage clamp, a third MOSFET (Q7), wherein the third MOSFET controls power to tools coupled to the perforating gun string, in which the voltage clamp when activated energizes a detonator in the perforating gun string.

A variation of the example embodiment may include a fourth MOSFET (Q8), wherein the fourth MOSFET controls power to the transformer. It may include a fifth MOSFET (Q2), wherein the fifth MOSFET regulates the voltage drop from the top of the tool to the bottom of the tool. It may include the first MOSFET (Q1) being a depletion mode MOSFET. It may include the first MOSFET (Q1) being controlled by the voltage of the second secondary coil of the transformer. It may include a Zener diode coupled to the fourth MOSFET. It may include the second MOSFET (Q5) being an enhancement MOSFET. It may include the second MOSFET (Q5) being powered by the first secondary windings of the transformer. It may include the third MOSFET (Q7) being a depletion mode MOSFET. It may include the third MOSFET (Q7) being powered by the third secondary windings of the transformer. It may include a 555 timer controlling the excitation of the transformer. It may include a fifth MOSFET (Q2), wherein the fifth MOSFET regulates the bottom of tool output current to a maximum level. It may include a fourth MOSFET (Q8), wherein the fourth MOSFET provides a constant current output to provide a control voltage. It may include a control voltage with energy storage element capacitor (C4) to provide adequate transformer primary current. It may include a resistor (R14) in series with MOSFET (Q2) for regulating the voltage drop from the top of the tool to the bottom of the tool. It may include temperature compensating diodes (D10, D14, D17, D18) in series with a Zener diode (D7).

BRIEF DESCRIPTION OF THE DRAWINGS

For a thorough understanding of the present invention, reference is made to the following detailed description of the preferred embodiments, taken in conjunction with the accompanying drawings in which reference numbers designate like or similar elements throughout the several figures of the drawing. Briefly.

DETAILED DESCRIPTION OF EXAMPLES OF THE INVENTION

In the following description, certain terms have been used for brevity, clarity, and examples. No unnecessary limitations are to be implied therefrom and such terms are used for descriptive purposes only and are intended to be broadly construed. The different apparatus, systems and method steps described herein may be used alone or in combination with other apparatus, systems and method steps. It is to be expected that various equivalents, alternatives, and modifications are possible within the scope of the appended claims.

Figure 1:
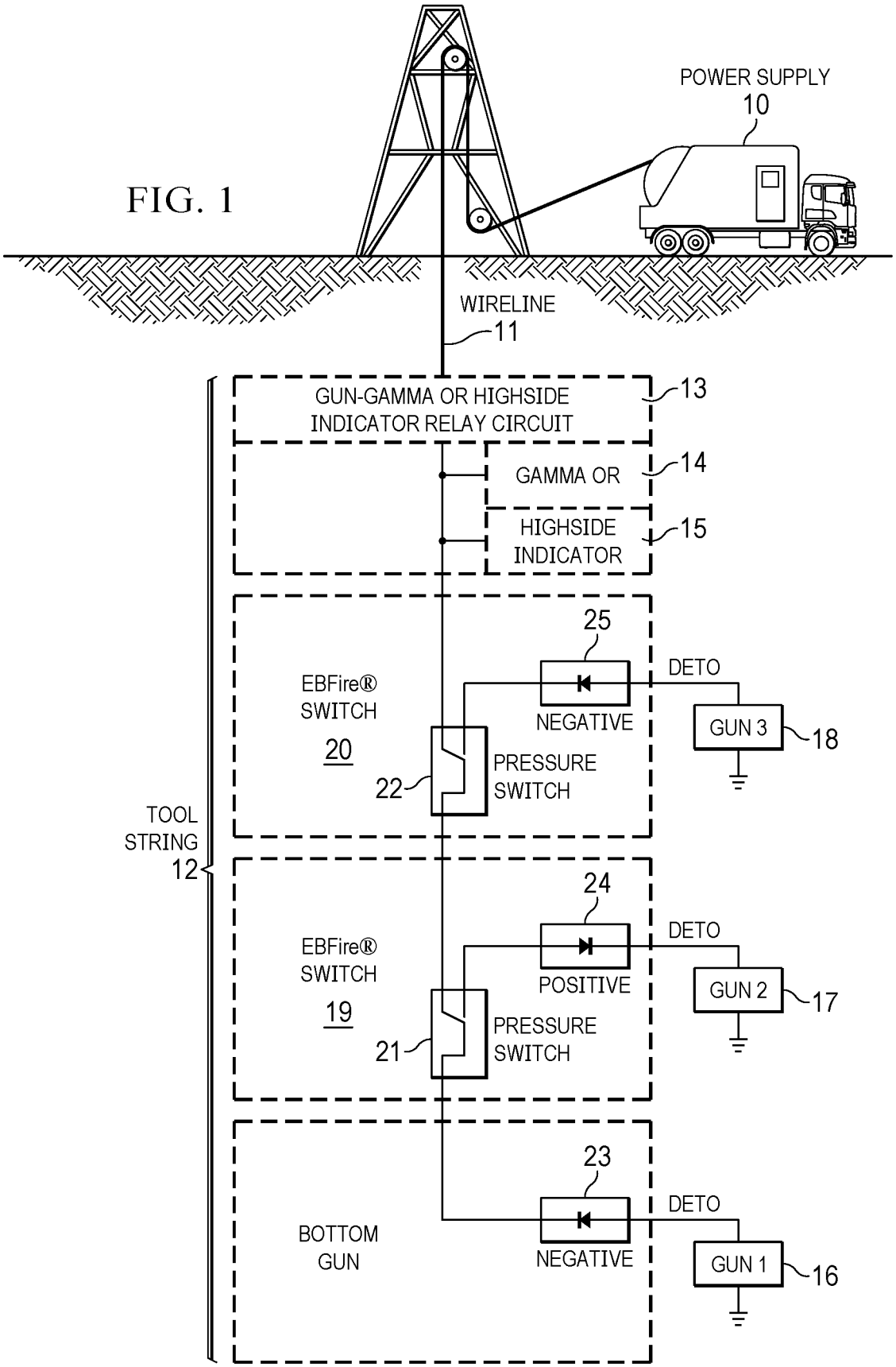
FIG. 1 shows the electrical firing system for a gun string suspended by wireline in a wellbore.

An example embodiment is shown in FIG. 1 with a surface shooting power supply 10 coupled to a wireline 11. The tool string 12 includes a solid state dual fire circuit 13, a gamma tool 14 or potentially a high side indicator 15, and then a series of perforating guns. The perforating guns include a bottom first gun having a detonator 16, a second gun detonator 17, and a third gun detonator 18. The first gun detonator 16 is fired directly from the solid state dual firing circuit 13. The second gun detonator 17 is coupled to a firing switch 19. The third gun detonator 18 is coupled to a firing switch 20. The firing switches 19 and 20 incorporate pressure switches 21 and 22, respectively. Diodes 23, 24, and 25 alternate the polarity required to fire each gun, thereby allowing the guns sequentially by switching the electrical polarity from the surface shooting power supply 10.

Figure 2A:
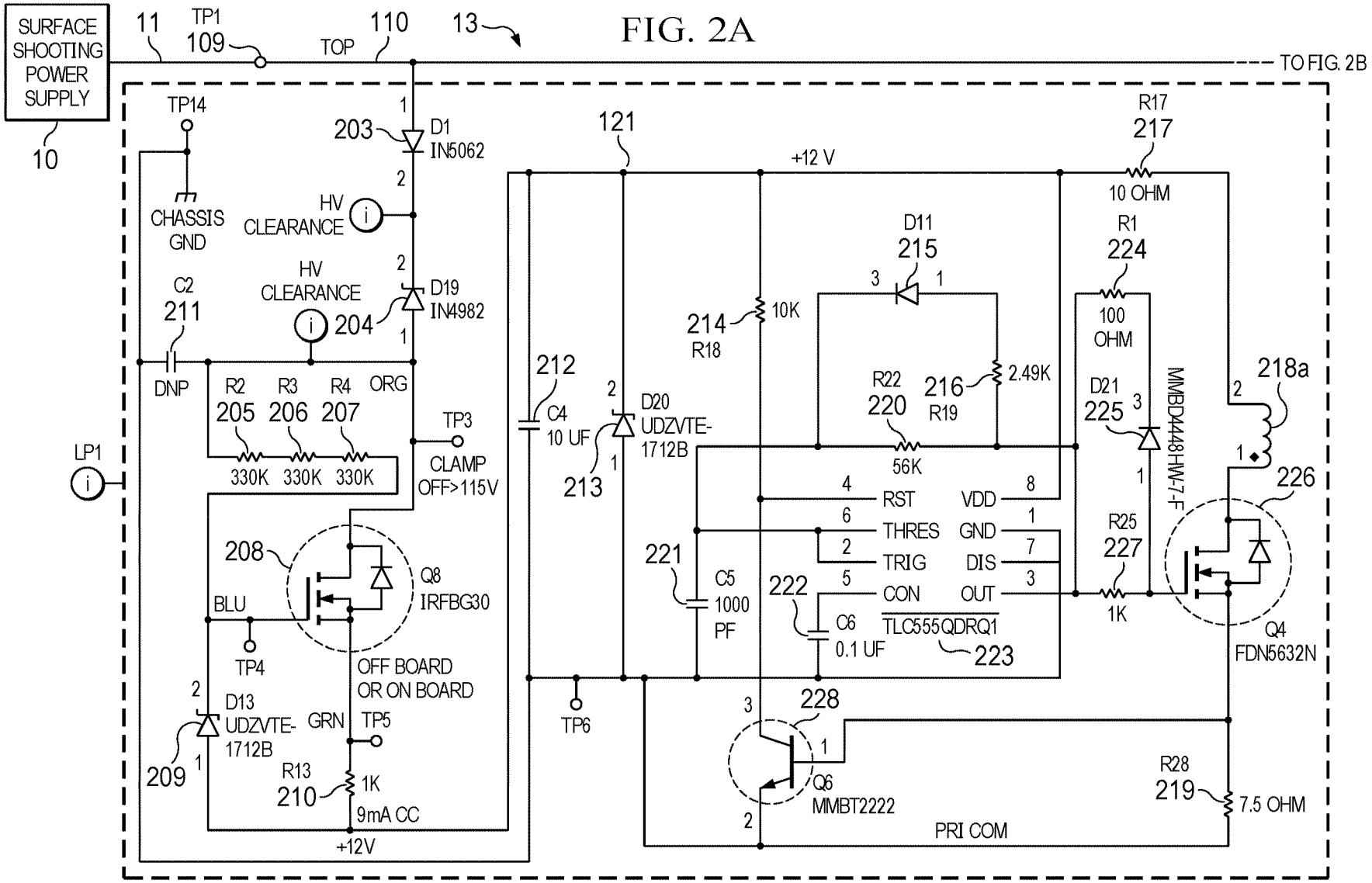
FIG. 2A-2C shows the schematic for a solid state dual fire circuit.
Figure 2B:
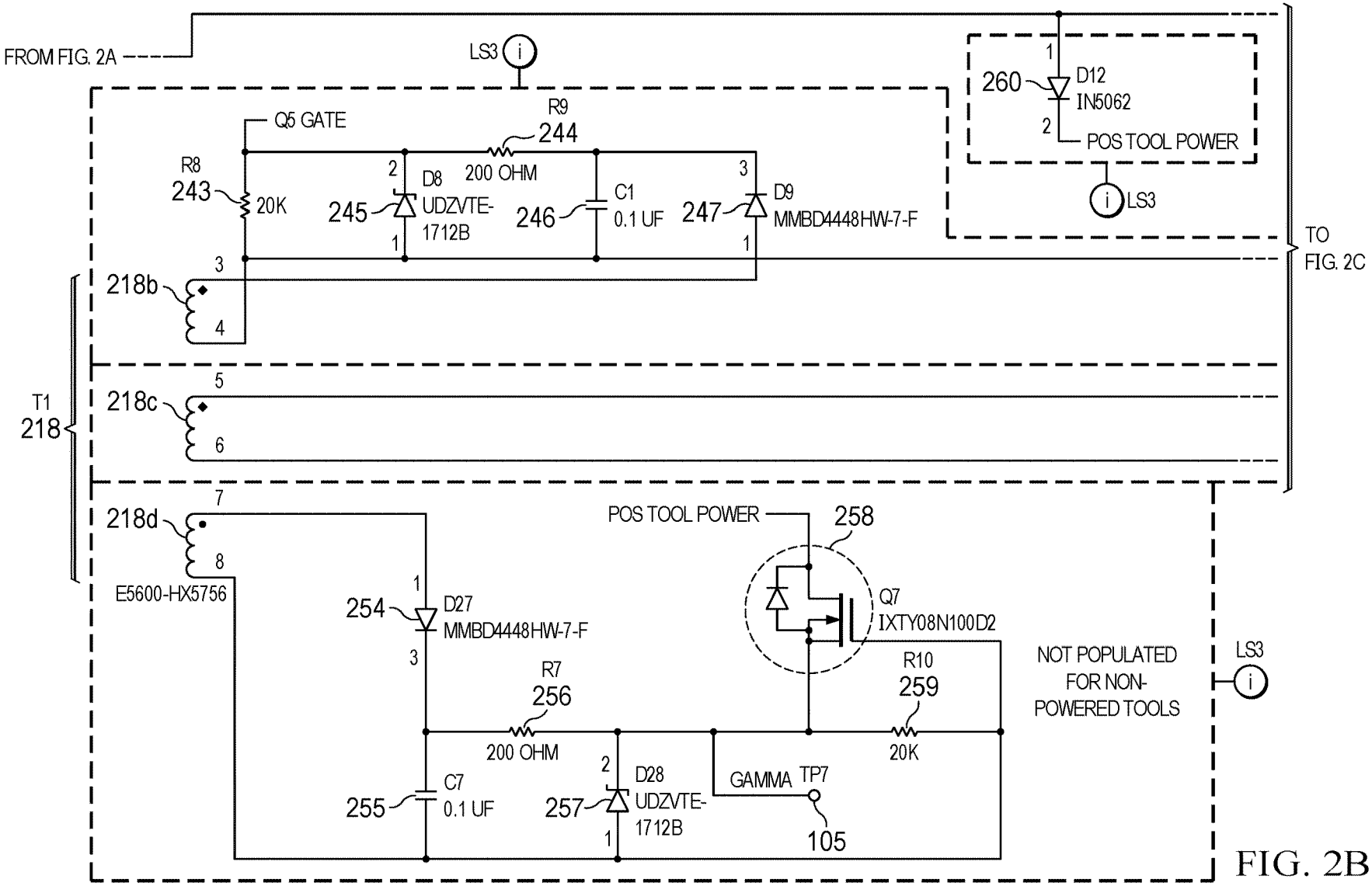
Figure 2C:
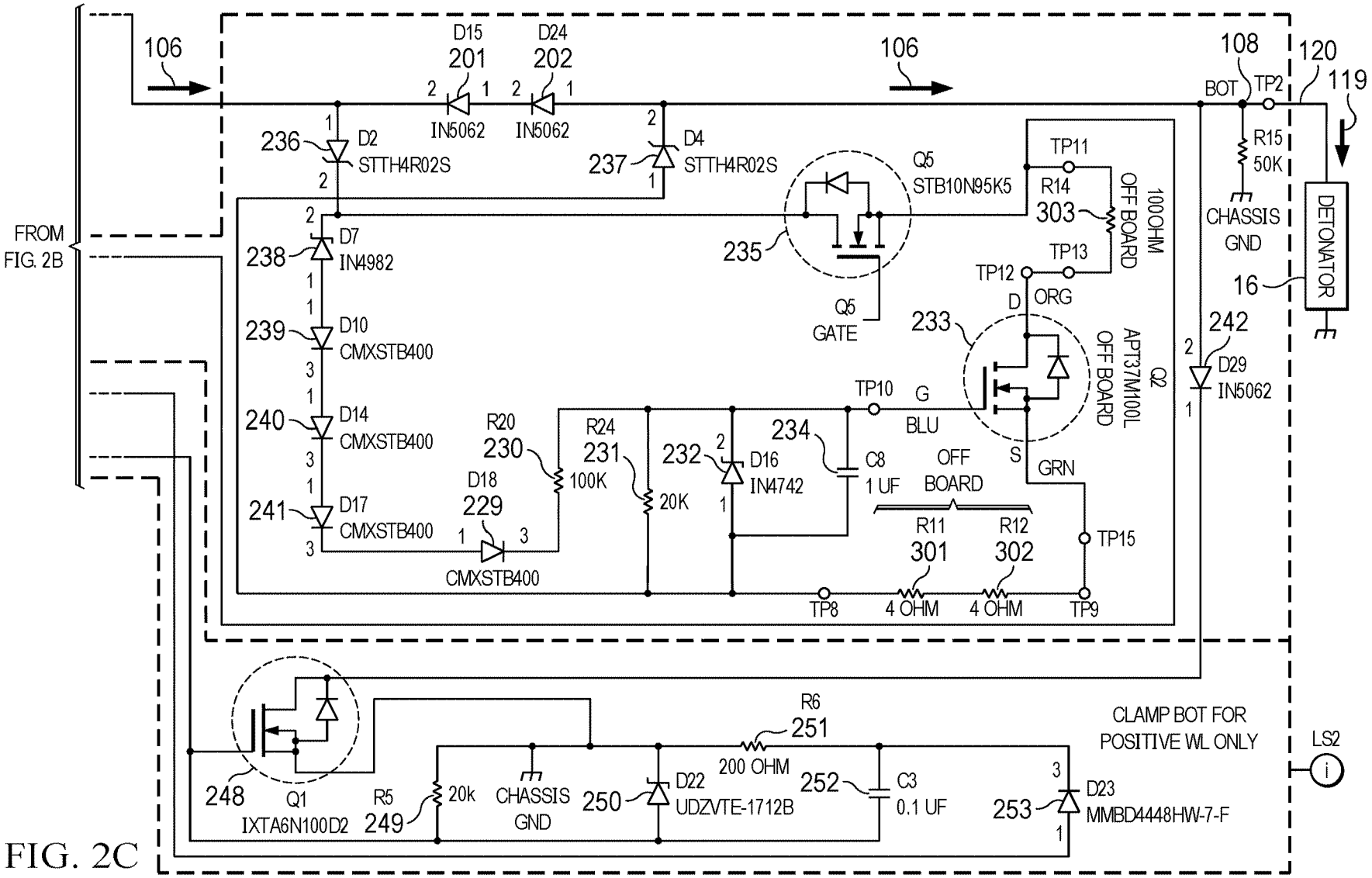

An example embodiment is shown in FIG. 2A-2C of the schematic details for solid state dual fire circuit 13. Wireline in 110 connects the wireline to the solid state dual fire circuit at the top of the tool. Wireline out 120 connects the wireline output to the solid state dual fire circuit 13.

The control circuitry is isolated from the output MOSFETS that switch the top of the tool to the bottom of the tool for firing. This isolation is controlled by a 4-winding 1:1 transformer, T1, 218. T1 218 is controlled by a TLC555 timer 223 which performs the task of a current mode, flyback-switch mode controller, driving the primary MOSFET Q4 226 about 36 kHz while consuming as little as 8 ma. T1 218 provides three isolated voltages, from secondary coils 218*b*, 218*c*, and 218*d*, which operate enhancement MOSFET, Q5 235, depletion MOSFET Q1 248, and depletion MOSFET Q7 258, respectively.

Power to the control circuit may be provided from the top of the tool to diode D1 203. When the top of tool voltage reaches the breakdown of Zener diode D19 204 of about 110V then the voltage is applied to drain of MOSFET Q8 208, which operates as a constant current regulator with an output of about 9 mA with a tool voltage from 115V to over 500V. This provides +12-13 volts, which is clamped by Zener diode D20 213 to the TLC555 timer 223 and the primary coil 218*a* of T1 218. NPN transistor Q6 228 provides cycle by cycle reset of the TLC555 timer 223 at peak primary current of T1 218, turning off the gate drive to MOSFET Q4 226. T1 218 primary peak current is about 65-100 ma peak. NPN Q6 228 base is biased by the voltage developed across shunt resistor R28 219 in the Q4 226 source lead to PRI-COM chassis ground. Resistor R18 214 at 10K ohms provides pull-up bias to pin 4 of U1 223 TLC555.

Diodes D15 201 and D24 202 provide a bypass around the Zener Diode Replacement Assembly ("ZDRA or Voltage Clamp") circuit, also may referred to as voltage clamp, for negative fire operation. Diodes D2 236 and D4 237 provide positive polarity rectification for the ZDRA circuit. The ZDRA circuit provides a standoff voltage on positive fire of about 125V and is regulated by the action of Q2 MOSFET 233, R14 303 and the Zener diode D7 238. Zener diode D7 238 is temperature compensated with the series string of diodes D10 239, D14 240, D17 241, and D18 229. When the top of tool voltage rises above 125V Zener diode D7 238 is reversed biased and turns MOSFET Q2 233 partially on which regulates at the 125V level with the excess line voltage dropped across resistor R14 303, 100 ohm, as the voltage rises above 125V, until a voltage level is reached in which the MOSFET Q2 233 is fully on. Current does not flow through the ZDRA circuit until the control circuit turns MOSFET Q5 235 on. The resistors R11 301 and R12 302, 4 ohm, in series with source pin of Q2 233 provide a current limiting function of Q2 233 to limit the ZDRA current to about 0.9-1.1 amps which protects Q2 233 and R14 303.

The bottom of the tool is clamped by depletion mode MOSFET Q1 248 for positive voltages, which is typically leakage from the diodes D15 201 and D24 202 and leakage of the ZDRA circuit. The Q1 248 clamp is normally on with no control voltage applied to the gate of Q1 248. When the control circuit operates, T1 218 secondary at pins 5 and 6, 218*c*, providing a negative 10 to −12V to turn Q1 248 off, removing the bottom of tool short to the armor. The turnoff occurs at a top of tool voltage of +115V before the ZDRA circuit is enabled at +125V.

The same action of the control circuit biases the MOSFET Q5 235 on to allow the ZDRA circuit to connect from the top of the tool to the bottom of the tool for line voltage above 115V. T1 218 secondary winding at pins 3 and 4, 218*b*, provide about +10 to +12V bias to the gate of MOSFET Q5 235 for line voltage 110 above 115V.

Also the control circuit operates to turn off depletion mode MOSFET Q7 258, which is normally on to provide tool power to the Gamma 105 or other tool circuitry below positive 115V on the top of tool 110. T1 218 secondary winding at pins 7 and 8, 218*d*, provide about −10 to −12V bias to the gate of MOSFET Q7 258 for line voltage 110 above 115V. This circuit may be optional if tool power does not need to be switched off. Diode D12 260 blocks negative voltage to the tool power output connected to the drain lead of MOSFET Q7 258. Diode D12 260 may be omitted if the Gamma circuit contains a line blocking diode. C2 211 may be omitted as well.

The 330K resistors R2 205, R3 206, and R4 207 are in series with each other to provide bias to the gate of Q8 208. Three resistors are used to limit the voltage across each resistor and power dissipation requirements. Zener diode D13 209 controls the gate bias of Q8 208 at 12V maximum for constant current regulation of 8-9 mA. Capacitor C4 212, at 10 μF in this example, controls the circuit power supply input filter. C4 212 is an important component as this capacitor supplies the peak primary current to T1 218. Capacitor C5 221, at 1000 pF in this example, controls the gate drive frequency of Q4 226. Capacitor C6 222, at 0.1 μF in this example, provides a filter capacitor for TLC555 Timer 223 reference at pin 5. Resistor R13 210 provides Q8 208 source feedback for constant current thru Q8 208 to the control circuit.

Diode D11 215 in conjunction with resistor R19 216 limit the output duty cycle by shunting R22 220 controlling the output pulse width of the 555 Timer 223. Resistor R17 217 provides current limiting of T1 218 primary coil 218*a*. Diode D21 225, resistor R1 224, and shunt resistor R25 227 providing fast fall time of Q4 226 gate drive.

Resistor R8 243 provides bias pull down of Q5 235 gate. Resistor R9 244 provides gate bias to Q5 235. Zener diode D8 245 clamps the secondary voltage of secondary coil 218*b* to 12 volts. Capacitor C1 246 is a filter capacitor for Q5 235 gate/source. Diode D9 247 provides rectification of secondary coil 218*b* for Q5 235 gate drive.

Resistor R20 230 provides bias of Q2 233 gate, in series with D7 238 Zener diode and compensating diode string D10 239, D14 240, D17 241 and D18 229. R24 231 pulls the gate bias of Q2 233 to the source lead to keep Q2 233 off when the line voltage 110 is below 125V. Zener diode D16 232 clamps Q2 233 gate voltage to 12 volts. Capacitor C8 234 is a filter capacitor for Q2 233 gate/source. C8 234 functions to provide for slew limiting of the gate voltage of Q2 233 to prevent or reduce turn-on current surges or spikes of the ZDRA circuit.

Diode D2 236 provides a connection to the ZDRA input from the top of the tool. Diode D4 237 provides a connection from the ZDRA output to the bottom of the tool. Diode D29 242 shorts positive leakage current from the bottom of the tool to the chassis ground thru Q1 248.

Zener diode D22 250 clamps the secondary coil 218*c* voltage to 12 volts. Resistor R6 251 provides gate bias to Q1 248. Capacitor C3 252 is a filter capacitor for Q1 248 gate/source. Diode D23 253 provides rectification of secondary coil 218*c* voltage for Q1 248 gate drive. Resistor R5 249 provides bias pull down of Q1 248 gate.

Capacitor C7 255 is a filter capacitor for Q7 258 gate/source. Diode D27 254 provides rectification of the secondary coil 218*d* voltage for Q7 258 gate drive. Resistor R7 256 provides gate bias to Q7 258. Zener diode D28 257 clamps the secondary coil 218*d* voltage to 12 volts. Resistor R10 259 provides bias pull down of Q7 258 gate.

Diode D1 203 may be a full wave bridge rectifier. Capacitor C8 234 may connect the gate to the source of Q2 233. If D1 203 is a bridge rectifier then D2 236 and D4 237 would be expanded with two additional diodes added for full bridge rectification of the ZDRA circuit, allowing the ZDRA to function with negative polarity as well as positive polarity of the wireline voltage.

Figure 3:
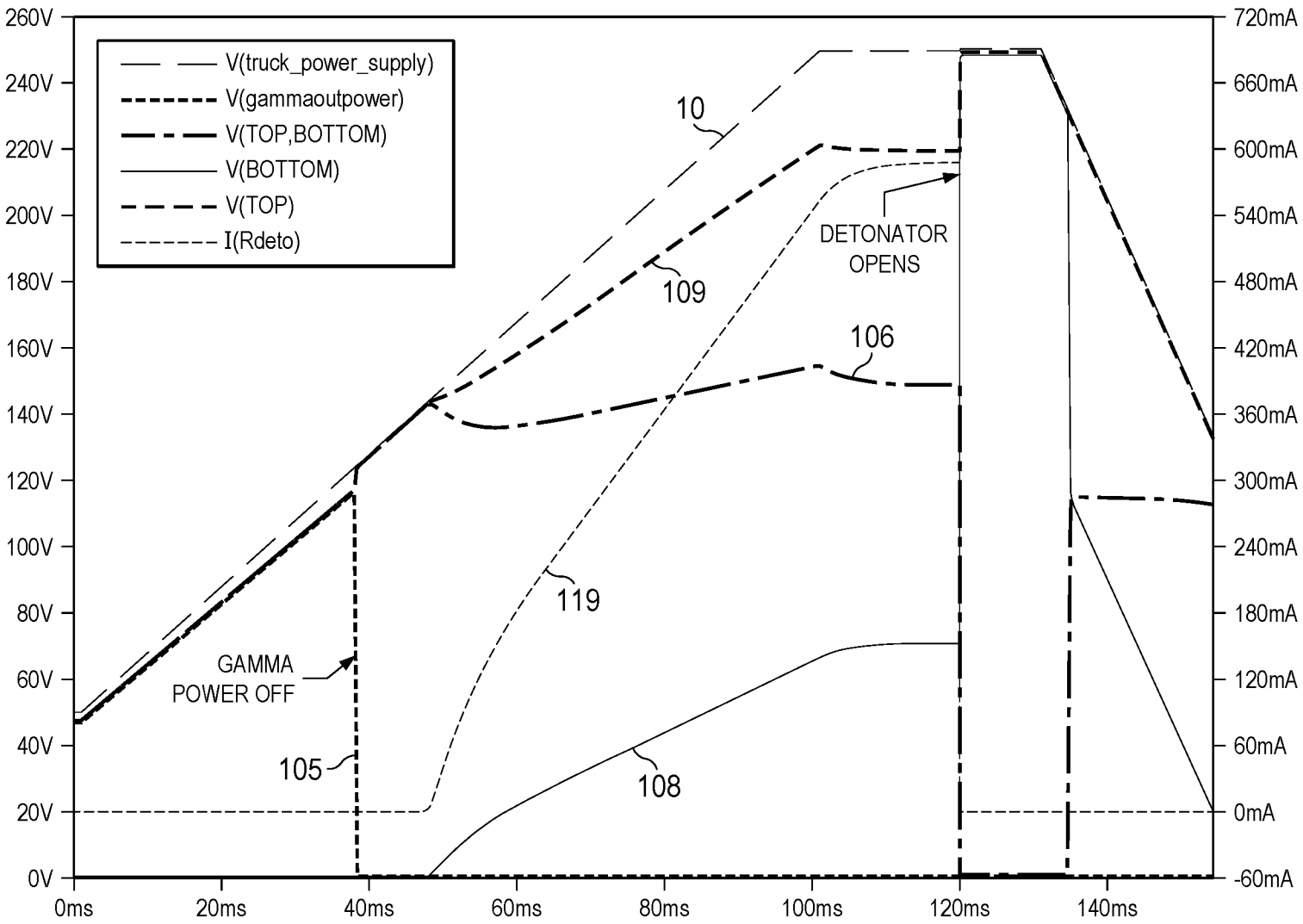
FIG. 3 shows a charge of the relationship of various voltages when the wireline voltage is ramped up, held steady, and then ramped down versus time when using a 120 ohm detonator.

The chart in FIG. 3 depicts the voltage relationship at various parts of the circuit when the wireline voltage ramps up from 50V to 250V in 100 ms. The bottom tool output 108 is coupled to a detonator 16 for a positive polarity gun. In this example the detonator 16 is a 120 ohm detonator. The secondary coils 218*b* provide negative voltage bias to the gate of MOSFET Q7 258 above positive 115V, thereby turning off the depletion mode of MOSFET Q7 258 and deactivating the gamma tool or any other tool powered by lead 105 at approximately 38 ms. The bottom tool voltage at output 108 begins ramping up at about 47.7 ms to a maximum voltage of 70.4V. The bottom tool current 119 going into the detonator 16 ramps up to 586 mA, burning open the detonator 16 at 120 ms, where the current 119 drops to zero. The voltage across the tool, from the top to the bottom of the tool, 106 begins at about 142V at 48 ms and before the detonator 16 opens, then the voltage across the tool 106 rises to 148V. A small delay may exist from the time the voltage at the top of the tool 109 rises to the maximum value of 221V until the detonator 16 current peaks at 586 mA of about 15 ms.

Figure 4:
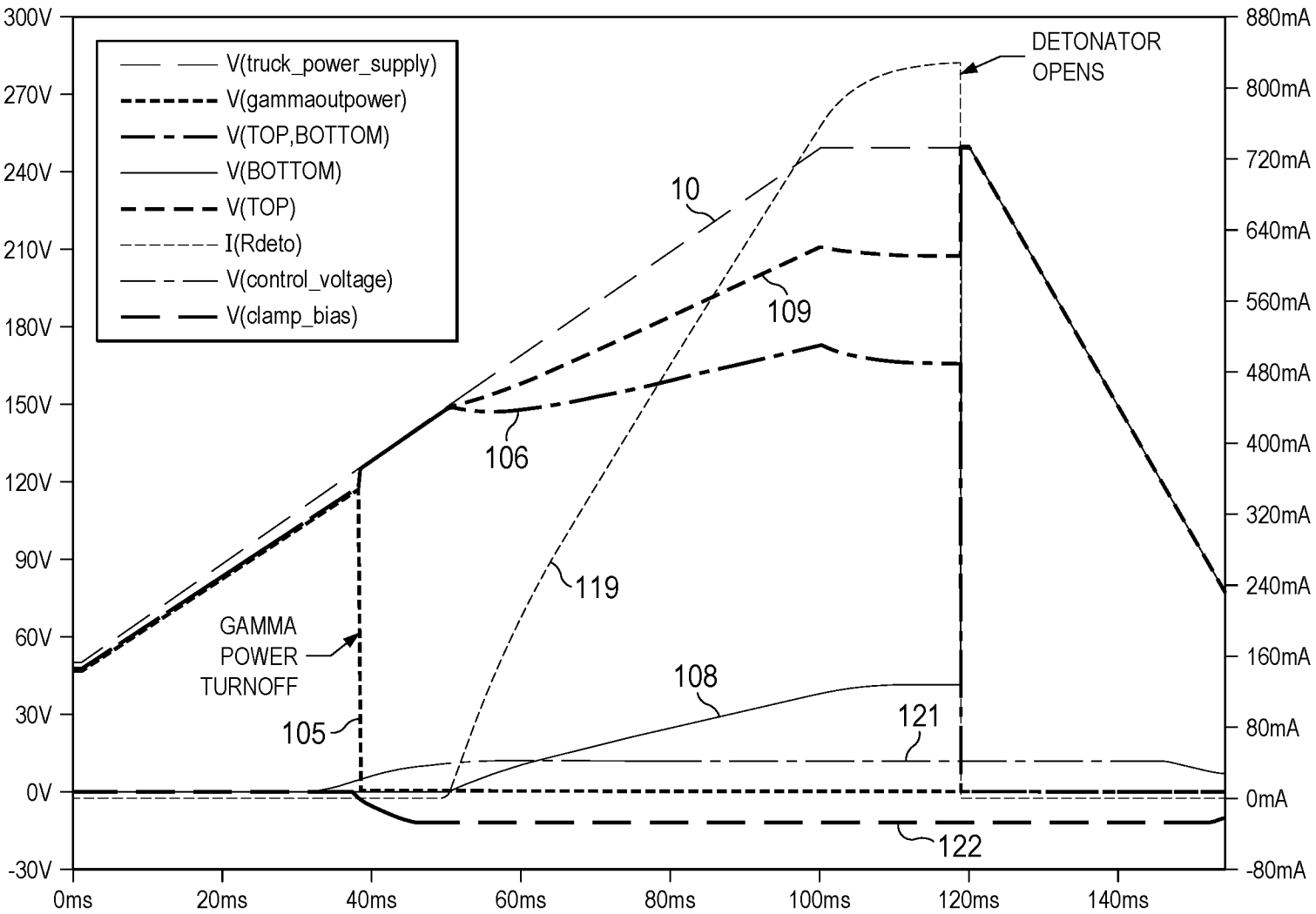
FIG. 4 shows a charge of the relationship of various voltages when the wireline voltage is ramped up, held steady, and then ramped down versus time when using a 50 ohm detonator.

The chart in FIG. 4 depicts the voltage relationship at various parts of the circuit when the wireline voltage from the supply 10 is ramped from 50V to 250V in 100 ms, when using a 50 ohm detonator 16 with positive polarity gun. The voltage across the tool 106 (the voltage difference from the top to the bottom of the tool) is maintained in the range of 150-165V drop beginning at about 147V at the top of the tool 109. The gamma tool power 105 switches off at about 118V at the top of the tool 109. The detonator 16 opens at 120 ms at 0.84 amps (50 ohm detonator 16 second gun up from the bottom of the tool). There is about a 20 ms delay ramping up to full detonation current once the voltage supply 10 reaches 250V at the surface. Control voltage, measured at node 121, begins ramping up at about 33 ms with 108V at the top of the tool 109. The control voltage 121 reaches a maximum value of 12V at 53.5 ms. Voltage clamp bias 122 begins ramping up at 37.9 ms when the control voltage 121 reaches about 3.5V and ramps to negative 11.9V at 46.5 ms. After a small delay the tool bottom voltage 108 beings ramping up at about 50.8 ms when the top of the tool 109 reaches 139.8V. The tool bottom voltage reaches a maximum of about 41.6V before the detonator 16 burns open.

Figure 5:
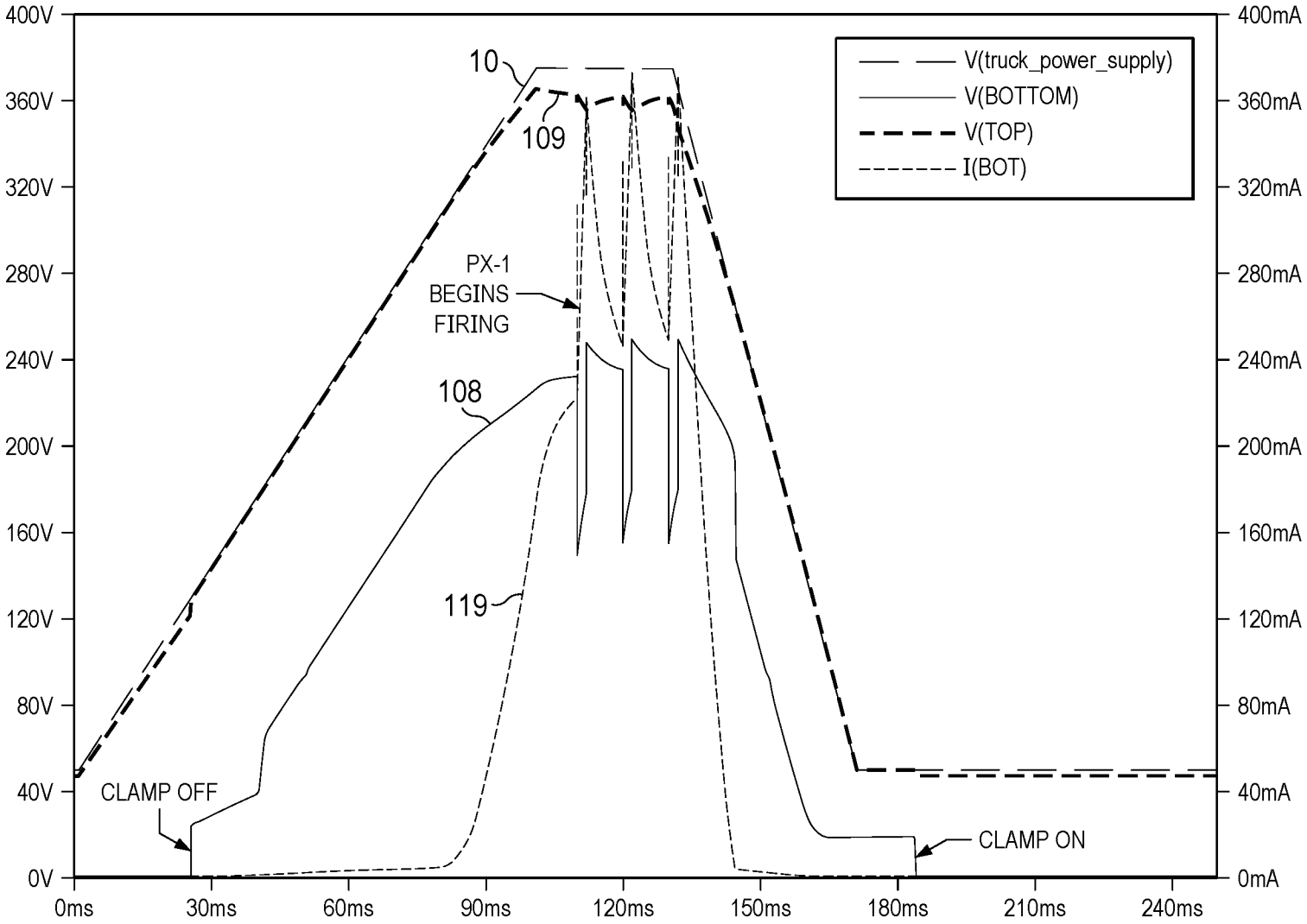
FIG. 5 shows a charge of the relationship of various voltages when the wireline voltage is ramped up, held steady, and then ramped down versus time when using a PX-1 type detonator.

The chart in FIG. 5 depicts the voltage relationship at various parts of the circuit when the wireline voltage supply 10 rises from 50V to 375V at the surface in 100 ms, using a PX-1 type detonator 16. The voltage at the bottom of the tool 108 rises to about 231V before the PX-1 begins firing the detonator as seen with the current pulses for the detonator current 119. The PX-1 begins drawing current as the bottom tool voltage 108 rises above 200V. The voltage drop from the top of the tool to the bottom of the tool is about 131V when the top of the tool 109 rises to 363.5V, controlled by the action of the MOSFET Q2 233 circuit. The bottom clamp turns off at about 25.3 ms with the top of the tool voltage reading 120V. The leakage voltage from the series diodes D15 201, D24 202, and the MOSFETs Q5 235 and Q2 233 circuit cause a voltage step of about 25V on the bottom of the tool 108 when the bottom clamp, Q1 248, turns off, with a leakage current of about 800 uA. As the voltage supply 10 from the wireline truck falls there is about a 20 ms delay from when the control voltage falls below about 3V until the bottom clamp turns back on at 184 ms.

Figure 6:
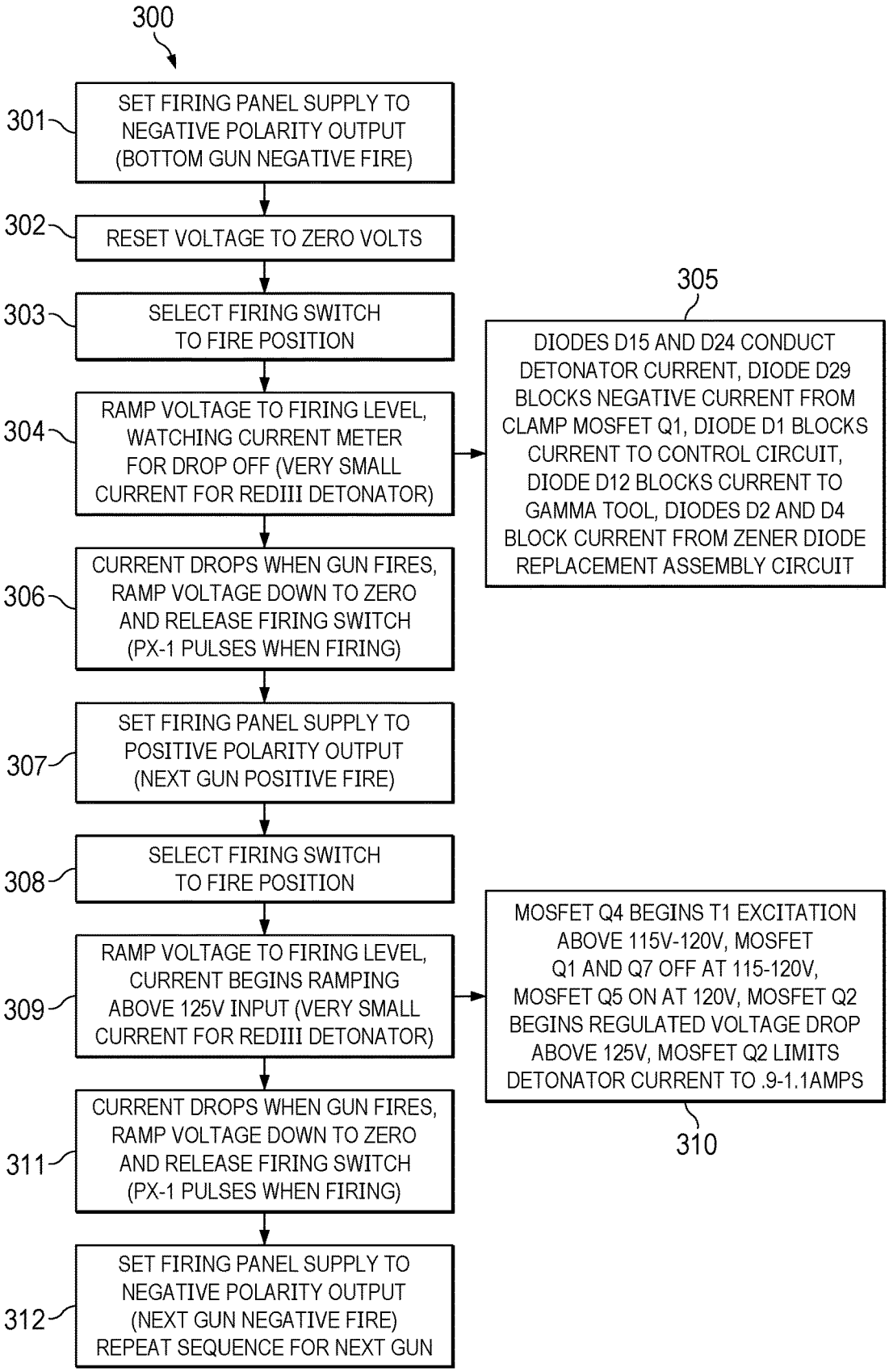
FIG. 6 shows a flow diagram of the process to fire a detonator.

FIG. 6 discloses a firing process 300. The firing panel supply is set to a negative polarity output 301. The bottom gun is fired by a negative polarity. The voltage is reset to zero volts 302. The firing switch is selected to the firing position 303. The voltage is ramped to the firing level, while the system watches the current meter for a predetermined drop off 304. The current drop off may be very small, for example when using a RedIII detonator. During the ramp up several things happen at once in 305, Diodes D15 and D24 conduct detonator current, diode D29 blocks negative current from clamp MOSFET Q1, Diode D1 blocks current to the control circuit, Diode D12 blocks current to the gamma tool, Diodes D2 and D4 block current from the Zener diode replacement assembly circuit. The firing of the gun at 306 causes the current to drop, the operator then ramps the voltage down to zero and releases the firing switch. For a detonator such as PX-1 the current pulses when the gun fires. After firing bottom gun, the firing panel supply is set to positive polarity output at 307, which is used to fire the next gun. The firing switch is selected to the fire position 308. The voltage is ramped to the firing level at 309, the current begins ramping when the voltage goes above the 125V input. At 310 several events occur simultaneously, the MOSFET Q4 begins exciting transformer T1 when the voltage exceeds 115V-120V, MOSFET Q1 and Q7 switch off at 115V-120V, MOSFET Q5 turns on at 120V, MOSFET Q2 begins its regulated voltage drop above 125V, MOSFET Q2 limits the detonator current to 0.9-1.1 amps. After the gun fires at 311 the current drops, the voltage is ramped down to zero, and the firing switch is released. At 312 the firing panel supply is set to negative polarity output to fire the next gun in the sequence.

When firing negative guns the detonator will usually contain a reversed biased diode in series with the detonator, as seen in FIG. 1, the bottom gun 16. The firing panel supply 10 will be set to negative polarity output and begin firing the bottom gun detonator when the voltage is ramped up. The current will bypass the solid state dual fire circuitry and only the reverse biased diodes D15 201 and D24 202 will conduct the detonator current. A much lower voltage is required when firing with negative polarity since there is no standoff voltage except for the forward bias drop of the 2 series diodes. If it is desired to provide a standoff voltage for both positive and negative voltages then a bridge rectifier can be used for D1 203 and a full bridge at D2 236 and D4 237. The present configuration is compatible with negative firing Control Fire type addressable switches.

Figure 7:
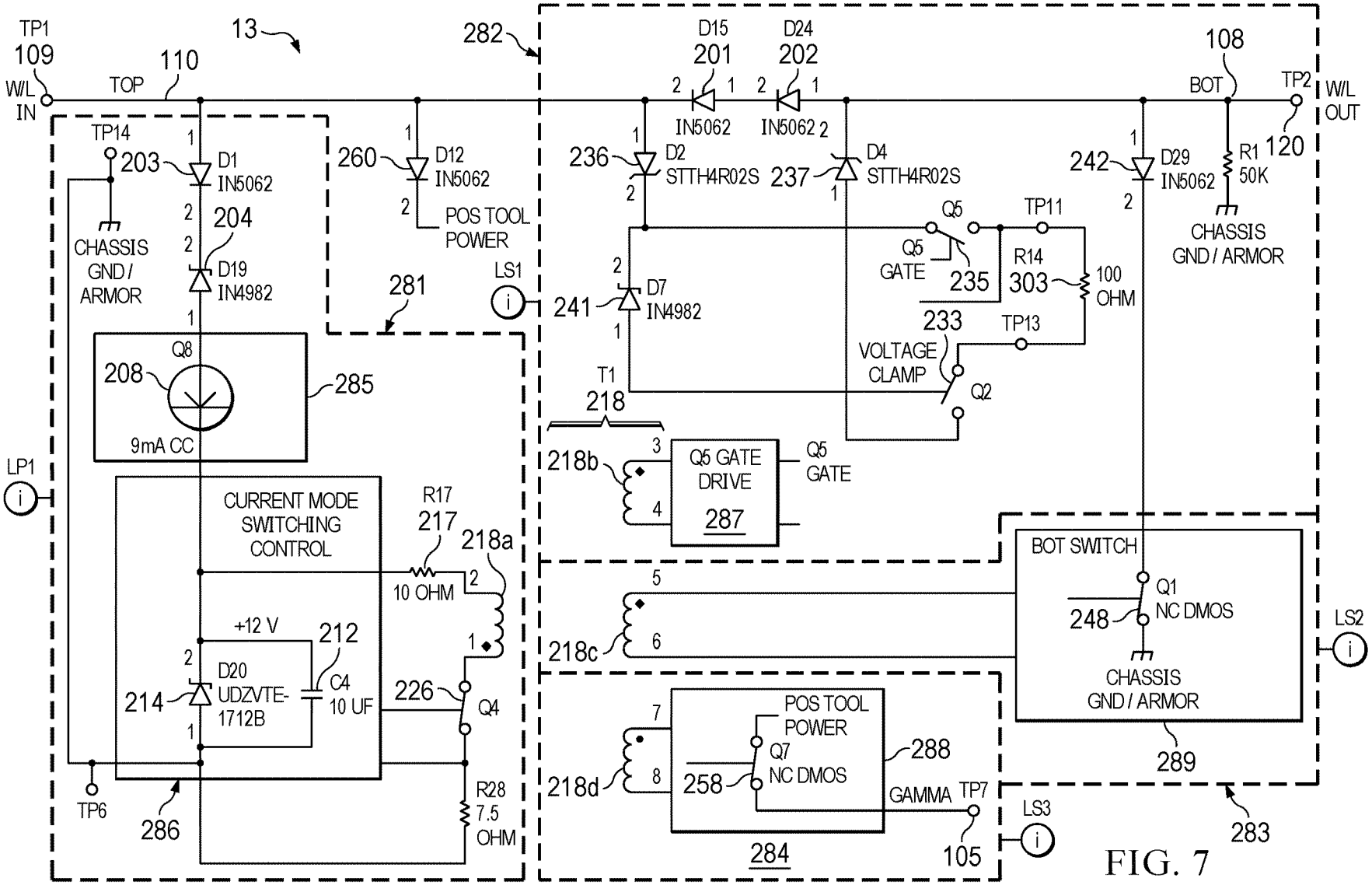
FIG. 7 shows a condensed block diagram version of the solid state dual fire circuit.

FIG. 7 discloses a simplified representation of solid state dual fire circuit 13 disclosed in FIG. 2A-2C. The primary control circuit 281 encompasses the input line voltage to the constant current limiter 285 through diode D1 203 and Zener diode D19 204, the +12 volt regulator and the TLC 555 timer 223 to switch the Q4 MOSFET 226 connected to the primary coil 218*a* of transformer T1 218.

The circuit 286 includes the TLC 555 timer 223, the Zener diode D20 213 and capacitor C4 212 and timing and drive components to drive the Q4 MOSFET 226 and the feedback transistor Q6 228 that limits the peak current in the transformer primary by resetting the TLC 555 timer 223 at peak current sensed by the voltage developed across R28 219 and applied to the base of Q6 228. Drive components are diode D21 225, resistor R1 224, resistor R25 227 with timing components capacitor C5 221, resistor R22 220, resistor R19 216 and diode D11 215. TLC 555 timer 223 reset pin is pulled to +12V with resistor R18 214 and pulled low by Q6 228. Capacitor C6 222 filters the TLC 555 timer 223 reference at pin 5. The operation of the circuit 286 provides a 30-50 khz drive to the gate of Q4 MOSFET 226 to drive the transformer primary 218*a* to generate the 3 secondary isolated gate voltages for the circuits 284, 289, and 287.

Circuit 282 encompasses all of the secondary side circuits including the ZDRA circuit and blocking diodes D15 201, D24 202, Q5 gate drive 287 (which includes MOSFET Q5 235), bottom clamp switch 283, and the gamma tool switch 284.

The 284 circuit encompasses item 288, the Gamma tool output D MOS transistor Q7 258, the secondary 218*d* and the gate drive components diode D27 254, Zener diode D28 257, capacitor C7 255, resistor R7 256 and resistor R10 259. This circuit rectifies the voltage output of the secondary winding 218*d* and applies the negative gate voltage to Q1 248 gate; Zener diode D28 257 clamps the negative gate voltage to 12V maximum, resistor R7 256 limits the Zener current and resistor R10 259 provides a pull down for turn-off of Q7 258.

MOSFET Q7 258 may be a D MOS transistor switch that connects the line voltage to the Gamma tool input at 105 to power the Gamma tool when the control circuit is not operated below 115V line voltage. When the control circuit operates above 115V line voltage the voltage output of secondary winding 218*d* provides bias for the 284/288 circuit to turn off the MOSFET Q7 258. MOSFET Q7 258 and 288 gate drive circuit components of the Gamma switch and secondary 218*d* make up item 284.

The circuit 287 encompasses the gate drive circuit for the MOSFET Q5 235. The 287 components include resistor R9 244, Zener diode D8 245, diode D9 247, resistor R8 243 and capacitor C1 246. Connected to the gate drive within circuit 287 is the secondary 218*b* winding. When the control circuit is not operated below 115V line voltage the gate of Q5 235 is pulled low by resistor R8 243 and Q5 235 is off. When the control circuit is operated with the line voltage above 115V the secondary winding 218*b* provides positive bias voltage to the gate of Q5 235 rectified by diode D9 247 and clamped by Zener diode D8 245 in the range of about 10V to 12V maximum. Resistor R9 244 limits Zener current and capacitor C1 246 filters the gate voltage. When the positive gate voltage is applied to Q5 235 gate, Q5 235 turns on to allow current to flow from the top of the tool through the ZDRA circuit to terminal 120, TP2 to the detonator.

Circuit 283 outline encompasses circuitry in 289 and the secondary winding 218*c*.

The 289 circuit contains the MOSFET Q1 248 and the gate drive circuit which is connected to the secondary winding 218*c* to provide a clamp of the bottom of tool through diode D29 242 to chassis ground when the control circuit is not operated with line voltage below 115V. MOSFET Q1 248 is normally on, conducting any leakage currents from diode D15 240, diode D24 202, and the ZDRA MOSFET 233 to ground with line voltage below 115V positive. The gate drive components of 289 consist of D23 253, C3 252, R6 251, D22 250, and R5 249. With the control circuit not operative below 115V line the gate is pulled low with R5 249 keeping Q1 248 on. When the control circuit is operated above 115V line then the output of 218*c* secondary winding is rectified by D23 253 and applied to the gate of Q1 248. The negative gate voltage is clamped by Zener D22 250 and R6 251 limits the Zener current. C3 252 filters the gate voltage. With negative gate voltage applied to Q1 248, the D MOS transistor turns off thus unclamping the bottom of the tool to allow current flow from the top of the tool to the bottom of the tool as the voltage is increased on the wire line.

The dashed circles around the MOSFET devices show the internal circuit of the MOSFET with the intrinsic body diode included. These are typical schematic symbols for MOSFET devices.

Although the invention has been described in terms of embodiments which are set forth in detail, it should be understood that this is by illustration only and that the invention is not necessarily limited thereto. For example, terms such as upper and lower or top and bottom can be substituted with uphole and downhole, respectfully. Top and bottom could be left and right, respectively. Uphole and downhole could be shown in figures as left and right, respectively, or top and bottom, respectively. Generally downhole tools initially enter the borehole in a vertical orientation, but since some boreholes end up horizontal, the orientation of the tool may change. In that case downhole, lower, or bottom is generally a component in the tool string that enters the borehole before a component referred to as uphole, upper, or top, relatively speaking. The first housing and second housing may be top housing and bottom housing, respectfully. In a gun string such as described herein, the first gun may be the uphole gun or the downhole gun, same for the second gun, and the uphole or downhole references can be swapped as they are merely used to describe the location relationship of the various components. Terms like wellbore, borehole, well, bore, oil well, and other alternatives may be used synonymously. Terms like tool string, tool, perforating gun string, gun string, or downhole tools, and other alternatives may be used synonymously. Also many other type detonators maybe used such as the REDIII type that has high impedance of about one megaohm and fires at 140-180V. The alternative embodiments and operating techniques will become apparent to those of ordinary skill in the art in view of the present disclosure. Accordingly, modifications of the invention are contemplated which may be made without departing from the spirit of the claimed invention.

What is claimed is:

1. A solid state dual fire circuit comprising:

a transformer with a primary coil, a first secondary coil, a second secondary coil, and a third secondary coil;

a first MOSFET (Q1), wherein the first MOSFET controls whether the bottom of the tool is shorted to ground;

a second MOSFET (Q5), wherein the second MOSFET engages or disengages a voltage clamp;

a third MOSFET (Q7), wherein the third MOSFET controls power to tools coupled to the perforating gun string; wherein the voltage clamp when activated energizes a detonator in the perforating gun string.

2. The solid state dual fire circuit of claim 1 further comprising a fourth MOSFET (Q8), wherein the fourth MOSFET controls power to the transformer.

3. The solid state dual fire circuit of claim 1 further comprising a fifth MOSFET (Q2), wherein the fifth MOSFET regulates the voltage drop from the top of the tool to the bottom of the tool.

4. The solid state dual fire circuit of claim 1 wherein first MOSFET (Q1) is a depletion mode MOSFET.

5. The solid state dual fire circuit of claim 1 wherein the first MOSFET (Q1) is controlled by the voltage of the second secondary coil of the transformer.

6. The solid state dual fire circuit of claim 2 further comprising a Zener diode coupled to the fourth MOSFET.

7. The solid state dual fire circuit of claim 1 wherein the second MOSFET (Q5) is an enhancement MOSFET.

8. The solid state dual fire circuit of claim 1 wherein the second MOSFET (Q5) is powered by the first secondary windings of the transformer.

9. The solid state dual fire circuit of claim 1 wherein the third MOSFET (Q7) is a depletion mode MOSFET.

10. The solid state dual fire circuit of claim 1 wherein the third MOSFET (Q7) is powered by the third secondary windings of the transformer.

11. The solid state dual fire circuit of claim 1 further comprising a 555 timer controlling the excitation of the transformer.

12. The solid state dual fire circuit of claim 1 further comprising a fifth MOSFET (Q2), wherein the fifth MOSFET regulates the bottom of tool output current to a maximum level.

13. The solid state dual fire circuit of claim 1 further comprising a fourth MOSFET (Q8), wherein the fourth MOSFET provides a constant current output to provide a control voltage.

14. The solid state dual fire circuit of claim 1 further comprising a control voltage with energy storage element capacitor (C4) to provide adequate transformer primary current.

15. The solid state dual fire circuit of claim 1 further comprising a resistor (R14) in series with MOSFET (Q2) for regulating the voltage drop from the top of the tool to the bottom of the tool.

16. The solid state dual fire circuit of claim 1 further comprising temperature compensating diodes (D10, D14, D17, D18) in series with Zener diode (D7).

* * * * *